US008681053B2

(12) United States Patent
Nagoshi et al.

(10) Patent No.: US 8,681,053 B2
(45) Date of Patent: Mar. 25, 2014

(54) ANTENNA APPARATUS RESONATING IN FREQUENCY BANDS IN INVERTED F ANTENNA APPARATUS

(75) Inventors: Masahiko Nagoshi, Osaka (JP); Wataru Noguchi, Hyogo (JP); Hiroyuki Yurugi, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/545,340

(22) Filed: Jul. 10, 2012

(65) Prior Publication Data

US 2012/0274517 A1 Nov. 1, 2012

Related U.S. Application Data

(63) Continuation of application No. PCT/JP2011/007104, filed on Dec. 20, 2011.

(30) Foreign Application Priority Data

Dec. 24, 2010 (JP) ..... 2010-287079

(51) Int. Cl.
*H01Q 1/38* (2006.01)

(52) U.S. Cl.
USPC ..... 343/700 MS; 343/702

(58) Field of Classification Search
USPC ..... 343/700 MS, 702
See application file for complete search history.

(56) References Cited

U.S. PATENT DOCUMENTS

| | | | | |
|---|---|---|---|---|
| 2007/0018892 | A1 * | 1/2007 | Ku et al. | 343/700 MS |
| 2009/0295652 | A1 | 12/2009 | Yagi et al. | |
| 2010/0060528 | A1 | 3/2010 | Chiu et al. | |

FOREIGN PATENT DOCUMENTS

| | | |
|---|---|---|
| DE | 101 47 921 | 4/2003 |
| EP | 1 881 554 | 1/2008 |
| JP | 2006-238269 | 9/2006 |
| JP | 2009-111999 | 5/2009 |
| JP | 2009-290522 | 12/2009 |
| JP | 2010-87752 | 4/2010 |

OTHER PUBLICATIONS

International Search Report issued Mar. 13, 2012 in International (PCT) Application No. PCT/JP2011/007104.
International Preliminary Report on Patentability and Written Opinion of the International Searching Authority issued Jul. 4, 2013 in International (PCT) Application No. PCT/JP2011/007104.

* cited by examiner

*Primary Examiner* — Dieu H Duong
(74) *Attorney, Agent, or Firm* — Wenderoth, Lind & Ponack, L.L.P.

(57) ABSTRACT

In an inverted F pattern antenna apparatus having a first antenna element and an electrical length of a quarter wavelength of a first resonance frequency, the inverted F pattern antenna apparatus having two resonance frequencies is configured to include a third antenna element and a second antenna element at an end portion of the first antenna element, and setting a length having an electrical length obtained by adding the electrical length of a further provided antenna element to the electrical length of the inverted F pattern antenna apparatus to the electrical length of a quarter wavelength of a second resonance frequency to achieve resonance at the second resonance frequency. In addition, a loop antenna is configured to include the first, third and second antenna elements and the grounding antenna element by capacitively coupling another end of the third antenna element to the grounding antenna element.

5 Claims, 12 Drawing Sheets

ANTENNA APPARATUS RESONATING IN FREQUENCY BANDS IN INVERTED F ANTENNA APPARATUS

This is a continuation application of PCT application No. PCT/JP2011/007104 as filed on Dec. 20, 2011, which claims priority to Japanese patent application No. JP 2010-287079 as filed Dec. 24, 2010, the contents of which are incorporated herein by reference.

BACKGROUND OF THE INVENTION

1. Field of the Invention

The present invention relates to an antenna apparatus that resonates in a plurality of frequency bands in an inverted F antenna apparatus.

2. Description of the Related Art

Utilization of wireless communications by mobile equipment inclusive of portable telephones as a representative, notebook personal computers and PDA (Personal Digital Assistants) is widespread. Among others, wireless LAN (Local Area Network) attracts attention as one of wireless communication systems. The currently popularized wireless LAN standards include IEEE802.11b/g/n that utilizes the 2.4-GHz band and IEEE802.11a/n that utilizes the 5-GHz band. The 2.4-GHz band is called the ISM (Industry Science Medical) band and utilized for other wireless communications such as Bluetooth (registered trademark) and cordless telephones, microwave ovens and so on, and therefore, interference easily occurs.

On the other hand, since the 5-GHz band also includes a frequency band limited to indoor uses and frequency bands limited in use at the time of radar detection, the 2.4-GHz band and the 5-GHz band are properly used in accordance with the use state. Therefore, developments of wireless equipment and antennas that can cope with both the frequency bands are demanded. Since it is difficult to install a plurality of antennas in the limited casing spaces of portable telephones, PDAs and the like, a dual-frequency shared antenna apparatus that covers the frequency bands of both the 2.4-GHz band and the 5-GHz band with a single antenna apparatus is necessary.

An inverted F antenna has been known as one of the antenna apparatuses that can be small-sized and built-in. As one example of a configuration for resonating the inverted F antenna in two frequency bands, there is an antenna described in a patent document 1 of Japanese patent laid-open publication No. JP 2006-238269 A.

FIG. 11 is a longitudinal sectional view showing a configuration of a prior art dual-frequency resonant antenna apparatus. Referring to FIG. 11, the antenna apparatus is described below by using XY coordinates having a coordinate origin O at one point on the upper surface 104*a* of a grounding conductor 104. An axis along the upper surface 104*a* of the grounding conductor 104 is assumed to be an X axis, and an axis extending from the coordinate origin O toward a perpendicular direction (upward direction) from the upper surface 104*a* of the grounding conductor 104 is assumed to be a Y axis.

Referring to FIG. 11, a first antenna element 101 has a length of $\lambda\alpha/4$, and resonates at a wavelength of $\lambda\alpha$. A second antenna element 102 has a length of $\lambda\beta/4$ and resonates at a wavelength of $\lambda\beta$. A Y-direction length long strip $\psi$ is grounded at the coordinate origin O and connected to the first antenna element 101 in the Y-axis direction. A Y-direction short strip y is connected to a feeding point 105, and is connected to the second antenna element 102 in the perpendicular direction.

In the antenna apparatus as configured as above, impedance matching is achieved at feeding points in the 2.45-GHz band and the 5-GHz band by the first antenna element 101 and the second antenna element 102, respectively, and then, a dual-band antenna apparatus is configured. Further, in the patent document 1, frequency band extension is achieved by placing an L-figured passive element 103 between the second antenna element 102 and the upper surface 104*a* of the grounding conductor 104.

FIG. 12 is a graph showing a frequency characteristics of the voltage standing wave ratio (hereinafter, referred to as VSWR) at the transmission of the dual-frequency resonant antenna apparatus of FIG. 11. As shown in FIG. 12, it can be understood that the frequency characteristic (tuning characteristic) of VSWR changes depending on the length dimension L of the passive element 103 shown in FIG. 11.

The patent document 1 has further had such a problem that a further size reduction is demanded since an antenna apparatus width matched to the longer wavelength is needed due to the parallel arrangement of antenna apparatuses in two rows in the horizontal direction with respect to the grounding conductor in accordance with two wavelengths.

SUMMARY OF THE INVENTION

An object of the present invention is to provide an antenna apparatus capable of further reducing the size in the inverted F antenna which resonates in two frequency bands.

In order to achieve the aforementioned objective, according to one aspect of the present invention, there is provided an antenna apparatus including a ground antenna element, first, second and third antenna elements, a feeding antenna element. The grounding antenna element has one end connected to a grounding conductor. The first antenna element is formed to be substantially parallel to a peripheral edge portion of the grounding conductor, and the first antenna element having one end connected to another end of the grounding antenna element. The feeding antenna element is configured to connect a feeding point with a predetermined connection point on the first antenna element. The third antenna element has one end connected to another end of the first antenna element. The second antenna element has one end connected to another end of the third antenna element. A first coupling capacitance is formed between the second antenna element and the grounding antenna element by bending another end of the second antenna element to be adjacent to the grounding antenna element so that another end of the second antenna element is electromagnetically coupled to another end of the grounding antenna element. A first length, from the feeding point via the feeding antenna element, a connection point on the first antenna element and the first antenna element, to another end of the first antenna element, is set to a length of a quarter wavelength of a first resonance frequency, so that a first radiating element having the first length resonates at the first resonance frequency. A second length, from the feeding point via the feeding antenna element, a connection point on the first antenna element, the first antenna element, the third antenna element and the second antenna element, to another end of the second antenna element, is set to a length of a quarter wavelength of the second resonance frequency, so that a second radiating element having the second length resonates at the second resonance frequency. A third length, from the feeding point via the feeding antenna element, a connection point on the first antenna element, the first antenna element, the third antenna element, the second antenna element and the first coupling capacitance, to the grounding antenna element, is set to a length which is one of a half wavelength and three-quarter wavelength of the first resonance frequency, so that a third radiating element having the third length and constituting a loop antenna resonates at the first resonance frequency.

In the above-mentioned antenna apparatus, the grounding antenna element is fondled to be substantially perpendicular to the peripheral edge portion of the grounding conductor. The third antenna element is formed to be substantially perpendicular to the peripheral edge portion of the grounding conductor. The second antenna element is formed to be substantially parallel to the peripheral edge portion of the grounding conductor.

In addition, in the above-mentioned antenna apparatus, the first antenna element, the second antenna element, the third antenna element, the feeding antenna element, and the grounding antenna element are formed on a substrate.

According another aspect of the present invention, there is provided an antenna apparatus including a grounding antenna element, first, second, third and fourth antenna elements, and feeding antenna element. The grounding antenna element has one end connected to a grounding conductor. The first antenna element is formed to be substantially parallel to a peripheral edge portion of the grounding conductor, and the first antenna element having one end connected to another end of the grounding antenna element. The feeding antenna element is configured to connect a feeding point with a predetermined connection point on the first antenna element. The third antenna element has one end connected to another end of the first antenna element. The second antenna element has one end connected to another end of the third antenna element. The fourth antenna element is formed on a surface opposite to the surface of the substrate on which the second antenna element is formed, and the fourth antenna element has one end connected to one end of the second antenna element via a through-hole conductor formed in a thickness direction of the substrate. A first coupling capacitance is formed between the second antenna element and the grounding antenna element by bending another end of the second antenna element to be adjacent to the grounding antenna element so that another end of the second antenna element is electromagnetically coupled to another end of the grounding antenna element. A second coupling capacitance is formed between the fourth antenna element and the grounding antenna element by bending another end of the fourth antenna element to be adjacent to the grounding antenna element so that another end of the fourth antenna element is electromagnetically coupled to another end of the grounding antenna element. A first length, from the feeding point via the feeding antenna element, a connection point on the first antenna element and the first antenna element, to another end of the first antenna element, is set to a length of a quarter wavelength of a first resonance frequency, so that a first radiating element having the first length resonates at the first resonance frequency. A third length, from the feeding point via the feeding antenna element, a connection point on the first antenna element, the first antenna element, the third antenna element, the second antenna element and the first coupling capacitance, to the grounding antenna element, is set to a length which is one of a half wavelength and three-quarter wavelength of the first resonance frequency, so that the third radiating element having the third length and constituting a loop antenna resonates at the first resonance frequency. A fourth length, from the feeding point via the feeding antenna element, a connection point on the first antenna element, the first antenna element, the third antenna element, the through-hole conductor, the fourth antenna element and the second coupling capacitance, to the grounding antenna element, is set to a length which is one of a half wavelength and three-quarter wavelength of the first resonance frequency, so that a fourth radiating element having the fourth length and constituting a loop antenna resonate at the first resonance frequency. A fifth length, from the feeding point via the feeding antenna element, a connection point on the first antenna element, the first antenna element, the third antenna element and the through-hole conductor, to another end of the fourth antenna element, is set to a length of a quarter wavelength of a second resonance frequency, so that a fifth radiating element having the fifth length and constituting an inverted F antenna resonates at the second resonance frequency.

In the above-mentioned antenna apparatus, the first antenna element is formed so that a width from another end of the first antenna element to a connection point between the first antenna element and the feeding antenna element is gradually expanded in a shape of taper shape toward the connection point.

Therefore, according to the present invention, the antenna width can be reduced by bending the end portion of the second antenna element in the direction of the grounding conductor. Since resonance can be achieved by the inverted F antenna that resonates in the first antenna element and the loop antenna, the first resonance frequency band (5-GHz band) can be expanded. Moreover, since the end portion of the second antenna element is bent, the antenna apparatus width is reduced to be small-sized.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
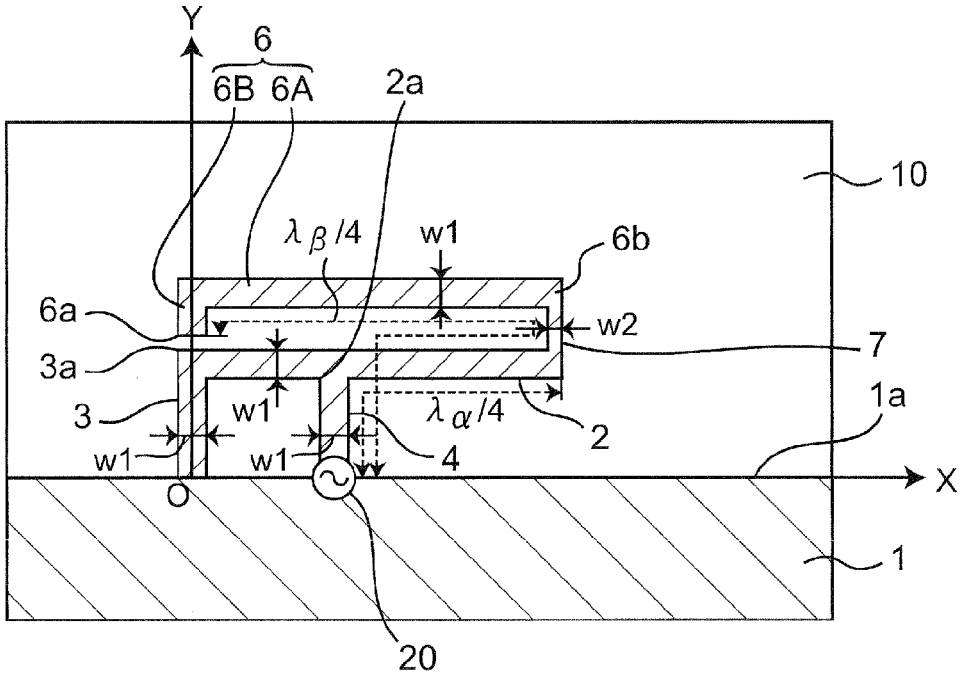
FIG. 1 is a plan view showing a configuration of an obverse surface of an antenna apparatus according to a first preferred embodiment of the present invention.

Preferred embodiments of the present invention will be described below with reference to the drawings. In the following preferred embodiments, like components are denoted by like reference numerals.

First Preferred Embodiment

FIG. 1 is a plan view showing a configuration of an obverse surface of an antenna apparatus according to the first preferred embodiment of the present invention. In FIG. 1, and below described FIGS. 3, 5 and 8, each antenna apparatus is described below by using the XY coordinates having the coordinate origin O at one point on the upper surface of a grounding conductor 1 formed on a dielectric substrate 10. An axis along the peripheral edge portion 1*a* of the grounding conductor 1 is assumed to be an X axis, and an axis extending from the coordinate origin O upward from the peripheral edge portion 1*a* of the grounding conductor 1 in each figure is assumed to be a Y axis. In this case, the opposite direction of the X-axis direction is referred to as the −X-axis direction, and the opposite direction of the Y-axis direction is referred to as the −Y-axis direction.

Referring to FIG. 1, the antenna apparatus of the present preferred embodiment is configured to include the grounding conductor 1, a first antenna element 2, a grounding antenna element 3, a feeding antenna element 4, a feeding point 20, a second antenna element 6, and a third antenna element 7. The antenna elements 2 to 7 and the grounding conductor 1 are each configured to include, for example, a conductor foil made of Cu, Ag or the like formed on the dielectric substrate 10 of a printed wiring board. It is noted that a grounding conductor may be formed or not formed on the reverse surface via the dielectric substrate 10 of the grounding conductor 1. Moreover, no grounding conductor is formed on the reverse surface via the dielectric substrate 10 of portions where the antenna apparatus including the antenna elements 2 to 7. Further, the grounding conductor 1 should be preferably formed such that the extending length in the −Y-axis direction becomes longer than the length of the second wavelength λβ. However, it is preferable to form the grounding conductor 1 in a case where radiation from the antenna apparatus is performed at comparatively high efficiency although the grounding conductor 1 needs not be formed in a case where grounding is performed at another end of the feed line when feeding is performed from the feeding point 20 via the feed line.

One end of the feeding antenna element 4 is connected to the feeding point 20. The feeding antenna element 4 is formed to be substantially parallel to the Y-axis direction, is extended in the Y-axis direction, and another end of the feeding antenna element 4 is connected to a predetermined connection point 2*a* of the first antenna element 2. One end of the grounding antenna element 3 is grounded to the grounding conductor 1 at the coordinate origin O. The grounding antenna element 3 is formed along the Y axis to be extended in the Y-axis direction, and another end of the grounding antenna element is connected to one end of the first antenna element 2. The first antenna element 2 is formed to be substantially parallel to the X axis, extending from the end connected to another end (upper end in the figure) of the grounding antenna element 3 in the X-axis direction via the connection point 2*a*, and another end of the first antenna element 2 is connected to one end of the third antenna element 7. The third antenna element 7 extends in the Y-axis direction from another end of the first antenna element 2, and is connected to one end 6*b* of the second antenna element 6. The second antenna element 6 is formed to be substantially parallel to the X-axis direction, extending in the −X-axis direction from another end of third antenna element 7, and is bent and extending in the −Y-axis direction at an intersection with the Y axis, where its open end is formed to be adjacent to another end 3*a* of the grounding antenna element 3 so as to be electromagnetically coupled to the end. In this case, the second antenna element 6 is configured to include an element portion 6A formed to be parallel to the X-axis direction and an element portion 613 formed to be parallel to the Y-axis direction, so that a coupling capacitance is generated between the open end of the element portion 6B and another end of the grounding antenna element 3. Although such a configuration that the first antenna element 2 extends in the X-axis direction is shown as one example, the element may extend in the −X-axis direction.

In the antenna apparatus as configured as above, the first antenna element 2 and the second antenna element 6 are formed to be substantially parallel to the X axis and the line of the peripheral edge portion 1*a* of the grounding conductor 1 formed along the X axis and to be substantially parallel to each other. Moreover, the feeding antenna element 4, the grounding antenna element 3 and the third antenna element 7 are formed to be substantially parallel to the Y-axis direction.

In this case, as shown in FIG. 1, a first radiating element is configured to include an antenna element that extends from the feeding point 20 via the feeding antenna element 4, and further extends from the connection point 2*a* via the first antenna element 2 to another end thereof. The length (electrical length) of the first radiating element is set to λα/4 that is a quarter wavelength of the first wavelength λα, and the first radiating element resonates at the first resonance frequency fα, so that a radio signal of a radio frequency having the first resonance frequency fα can be transceived. Moreover, a second radiating element is configured to include an antenna element that extends from the feeding point 20 via the feeding antenna element 4, and further extends from the connection point 2*a* via the first antenna element 2 to another end thereof and further extends via the third antenna element 7 and the second antenna element 6 to its open end at another end. The length (electrical length) of the second radiating element is set to λβ/4 that is a quarter wavelength of the second wavelength λβ, and the second radiating element resonates at the second resonance frequency fβ, so that a radio signal of a radio frequency having the second resonance frequency fβ can be transceived. Further, a third radiating element is configured to include an antenna element that extends from the feeding point 20 to the grounding conductor 1 by way of the feeding antenna element 4, the first antenna element 2 (limited to the right-hand portion of the figure from the connection point 2*a*), the third antenna element 7, the second antenna element 6, the aforementioned coupling capacitance, and the grounding antenna element 3. The length (electrical length) of the third radiating element is set to $\lambda\alpha/2$ that is a half wavelength of the first wavelength $\lambda\alpha$ (the length may be $3\lambda\alpha/4$), so that the third radiating element can operate as a so-called loop antenna that utilizes a mirror image generated in the grounding conductor 1 and transceives a radio signal of a radio frequency having the first resonance frequency $f\alpha$ in a manner similar to that of the first radiating element.

Moreover, the antenna elements 2, 3, 4 and 6 have a predetermined width w1, and the third antenna element 7 has a predetermined width w2. In this case, when the function of the loop antenna is used, the widths w1 and w2 are set to, for example, a mutually identical width. When the function of the loop antenna is not used, the third antenna element 7, which has an impedance higher than a predetermined threshold impedance with respect to the frequency of the first resonance frequency $f\alpha$, should be preferably set to have an impedance lower than the threshold impedance with respect to the second resonance frequency $f\beta$. With regard to the setting of the widths w1 and w2, the same thing can be applied to the other preferred embodiments.

Further, the position and the width w1 of the connection point 1*a* on the first antenna element 2 is set so that an impedance when seeing a wireless transceiver circuit (not shown) from the feeding point 20 via the feed line (not shown) substantially coincides with an impedance when seeing the antenna apparatus on the first antenna element 2 side from the feeding point 20. It is noted that, for example, a coaxial cable, a microstrip line or the like can be used as the feed line.

Figure 2A:
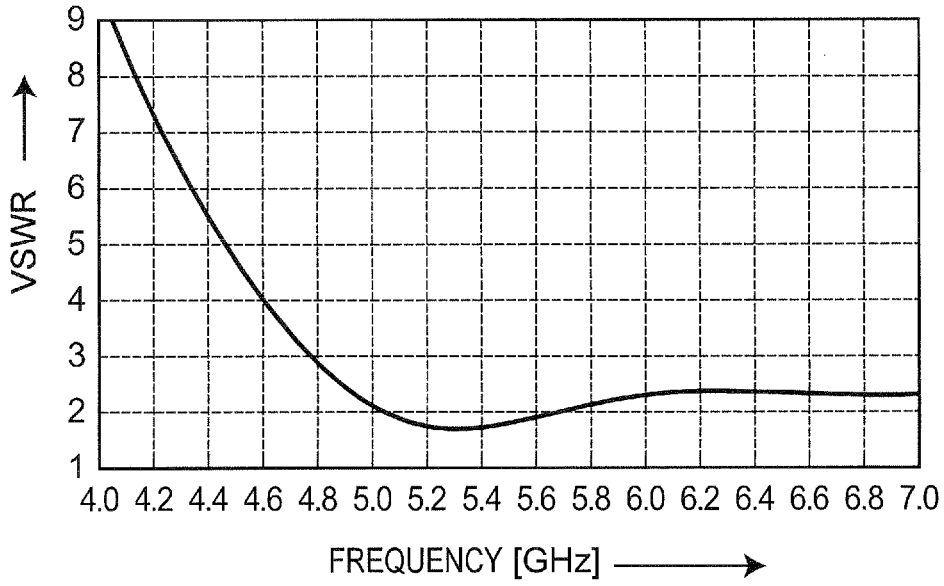
FIG. 2A is a graph showing a frequency characteristic of VSWR in the vicinity of a first resonance frequency fa in the antenna apparatus of FIG. 1.
Figure 2B:
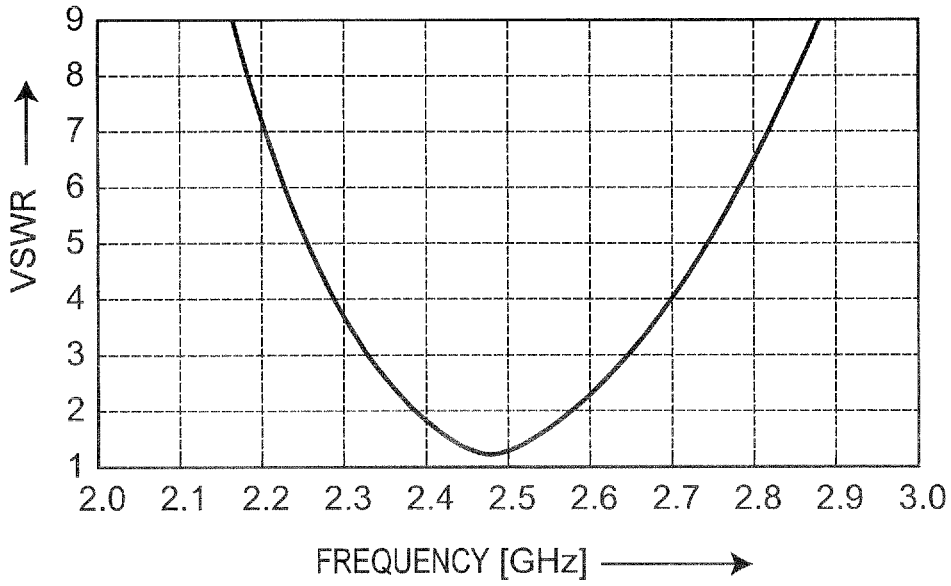
FIG. 2B is a graph showing a frequency characteristic of VSWR in the vicinity of a second resonance frequency fp in the antenna apparatus of FIG. 1.

FIG. 2A is a graph showing a frequency characteristic of VSWR in the vicinity of the first resonance frequency $f\alpha$ in the antenna apparatus of FIG. 1, and FIG. 2B is a graph showing a frequency characteristic of VSWR in the vicinity of the second resonance frequency $f\beta$ in the antenna apparatus of FIG. 1. Impedance matching is obtained in the 5-GHz band including the resonance frequency $f\alpha$ as apparent from FIG. 2A, and impedance matching is obtained in the 2.4-GHz band including the resonance frequency $f\beta$ as apparent from FIG. 2B.

A case where the first resonance frequency $f\alpha$ is in the 5-GHz band and the second resonance frequency $f\beta$ is in the 2.4-GHz band is considered here. Assuming that the wavelength of radio waves is $\lambda$ [m] (a length of 0 to 360 degrees ($2\pi$) in terms of the sine wave), the resonance frequency is $f\alpha$ [Hz], and the velocity of radio waves is c [m/sec] (constant at $3\times10^8$ [m/s] equal to the velocity of light), then the wavelength and the frequency are expressed by the equation of $\lambda$ [m]=c/$f\alpha$.

First of all, in the case where the first resonance frequency $f\alpha$ is 5 GHz, the first wavelength $\lambda\alpha$ is expressed by the following equation:

$$\lambda\alpha=c/f\alpha=3\times10^8/(5\times10^9)=0.06\ [\mathrm{m}] \quad (1).$$

Therefore, the length of the first radiating element is expressed by the following equation:

$$\lambda\alpha/4=0.015\ [\mathrm{m}]=1.5\ [\mathrm{cm}] \quad (2).$$

Next, in the case where the second resonance frequency $f\beta$ is 2.4 GHz, the second wavelength $\lambda\beta$ is expressed by the following equation:

$$\lambda\beta=c/f\beta=3\times10^8/(2.4\times10^9)=0.125\ [\mathrm{m}] \quad (3).$$

Therefore, the length of the second radiating element is expressed by the following equation:

$$\lambda\beta/4=0.03125\ [\mathrm{m}]\approx3\ [\mathrm{cm}] \quad (4).$$

As described above, in the case where the first resonance frequency $f\alpha$ is 5 GHz and the second resonance frequency $f\beta$ is 2.4 GHz, the first radiating element is required to have a length of about 1.5 cm with respect to the first resonance frequency $f\alpha$, and the second radiating element is required to have a length of about 3.0 cm with respect to the second resonance frequency $f\beta$. Moreover, as shown in FIG. 2A, there is a band of 4.9 to 7.0 GHz in which VSWR is not greater than 2.5 by virtue of the function of the loop antenna, and therefore, VSWR has a low value throughout a wide band.

In this case, although the antenna width in the X-axis direction is required to be about 3.0 cm in the configuration of the general inverted F antenna, the antenna width can be reduced to about 1.5 cm by virtue of the aforementioned configuration.

According to the antenna apparatus of the present preferred embodiment, the antenna apparatus including two antenna configurations which include the following:

(a) the so-called inverted F pattern antenna apparatus that resonates in the two frequency bands of the first resonance wavelength $\lambda\alpha$ and the second resonance wavelength $\lambda\beta$, i.e., the first resonance frequency and the second resonance frequency; and (b) the loop antenna that resonates at the first resonance frequency, then the antenna apparatus whose bandwidth is expanded at the first resonance frequency can be configured to be even more small-sized than the prior art.

Second Preferred Embodiment

Figure 3:
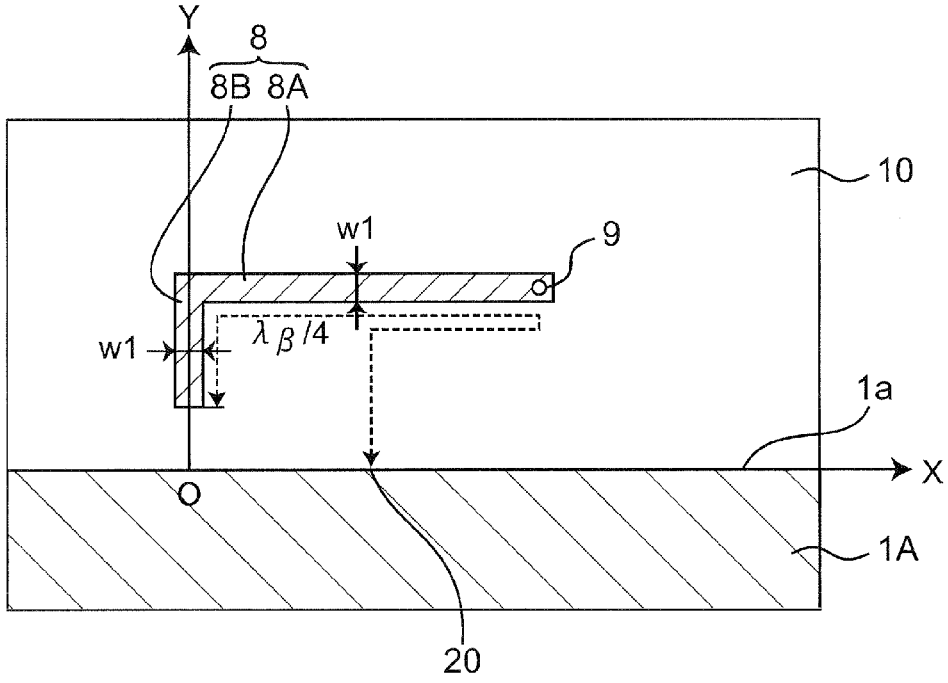
FIG. 3 is a plan view showing a configuration of the reverse surface of an antenna apparatus according to a second preferred embodiment of the present invention.

FIG. 3 is a plan view showing a configuration of the reverse surface of an antenna apparatus according to the second preferred embodiment of the present invention. FIG. 3 shows not any actual configuration but a perspective view seen from the obverse surface (indicated by solid lines for convenience in illustration although this should normally be indicated by dotted lines) for the sake of explanation of a relation to FIG. 1 and convenience in illustration, and the actual reverse surface is laterally reversed. The antenna apparatus of the second preferred embodiment is a preferred embodiment applied when the length of the second radiating element that resonates at the second resonance frequency $f\beta$ is shorter than the length of a quarter wavelength of the second resonance frequency.

In the present preferred embodiment, the antenna apparatus shown in FIG. 1 is formed on the obverse surface of the dielectric substrate 10, and the antenna apparatus of FIG. 3 is formed on the reverse surface of the dielectric substrate 10. It is noted that the second preferred embodiment assumes a case where a length from the feeding point 20 via the feeding antenna element 4 and further from the connection point 2*a* via the first antenna element 2 to another end thereof and further via the third antenna element 7 and the second antenna element 6 to another end thereof 6*a* is shorter than a quarter wavelength of the second wavelength $\lambda\beta$, and no resonance occurs at the second resonance frequency $f\beta$. It is noted that no description is provided for the contents identical to those of the first preferred embodiment.

Referring to FIG. 3, the antenna apparatus of the present preferred embodiment is configured to include grounding conductors 1 and 1A, a first antenna element 2, a grounding antenna element 3, a feeding antenna element 4, a feeding point 20, a second antenna element 6, a third antenna element 7, and a fourth antenna element 8. In this case, the neighborhood of the one end (right-hand end) of the second antenna 6 provided on the obverse surface of the dielectric substrate 10 and the neighborhood of the one end (right-hand end) of the fourth antenna element 8 (located on the reverse surface of a connection point 9) are connected together via a through-hole conductor 9 that is plated with metal and penetrates the dielectric substrate 10. The fourth antenna element 8 extends in the −X-axis direction, and the end portion of the fourth antenna element 8 is bent in the −Y-axis direction. Then an open end of another end of the fourth antenna element 8 is located to be adjacent to another end 3*a* of the grounding antenna element 3 so as to be electromagnetically coupled, and this leads to a capacitive coupling. That is, the fourth antenna element 8 is configured to include an element portion 8A formed to be parallel to the X-axis direction and an element portion 8B formed to be parallel to the Y-axis direction. Moreover, the grounding conductor 1A is formed on the reverse surface of the dielectric substrate 10 oppositely from the grounding conductor 1 of the obverse surface of the dielectric substrate 10.

In this case, a length, from the feeding point 20 at the lower end of the feeding antenna element 4 by way of the first antenna element 2 and the third antenna element 7 and via the one end (right-hand end) of the second antenna element 6 through the through-hole conductor 9, to the open end of the fourth antenna element 8, is set to be λβ/4 that is a quarter wavelength of the second wavelength λβ, so that an inverted F antenna resonating at the second resonance frequency fβ is established. Therefore, even in a case where the second antenna element 6 cannot secure an electrical length for achieving resonance at the second resonance frequency fβ (when the length (electrical length) of the second radiating element is smaller than λβ/4) due to restrictions in size reduction in the Y-axis direction, the present preferred embodiment allows the resonance at the second resonance frequency fβ to be achieved by virtue of the provision of the fourth antenna element 8 on the reverse surface of the dielectric substrate 10.

Figure 4A:
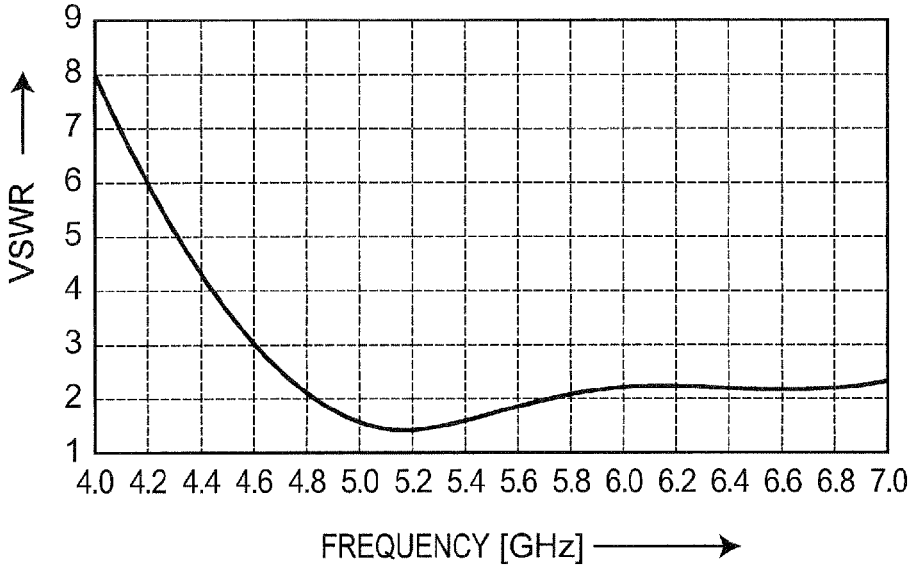
FIG. 4A is a graph showing a frequency characteristic of VSWR in the vicinity of the first resonance frequency fα in the antenna apparatus of FIG. 3.
Figure 4B:
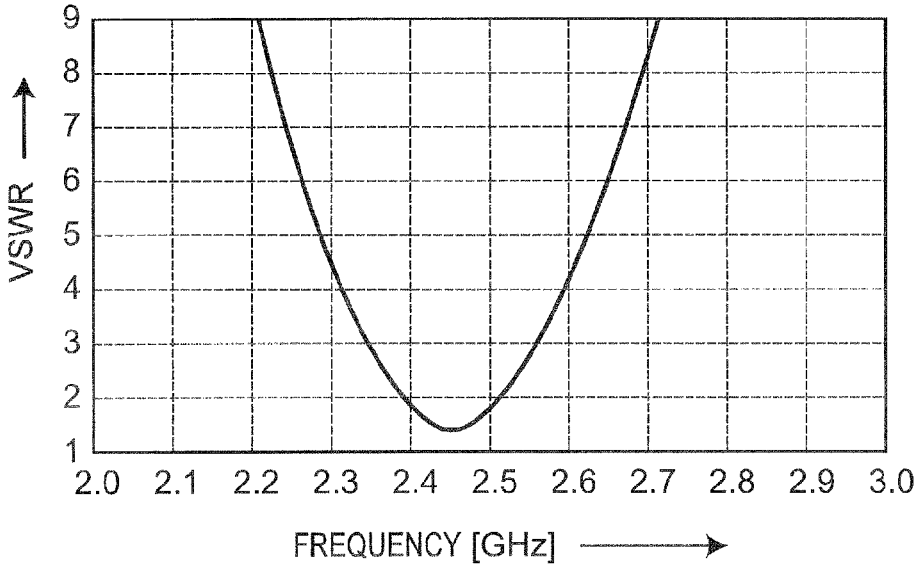
FIG. 4B is a graph showing a frequency characteristic of VSWR in the vicinity of the second resonance frequency fβ in the antenna apparatus of FIG. 3.

FIG. 4A is a graph showing a frequency characteristic of VSWR in the vicinity of the first resonance frequency fix in the antenna apparatus of FIG. 3, and FIG. 4B is a graph showing a frequency characteristic of VSWR in the vicinity of the second resonance frequency fβ in the antenna apparatus of FIG. 3. Impedance matching is obtained at 5 GHz including the resonance frequency fα as apparent from FIG. 4A, and impedance matching is obtained at 2.4 GHz including the resonance frequency fβ as apparent from FIG. 4B. Moreover, as shown in FIG. 4A, a wide bandwidth of 4.8 to 7.0 GHz where VSWR is not greater than 2.5 is obtained, and VSWR has a low value.

As described above, according to the present preferred embodiment, the dual antenna apparatus, which resonates in two antenna configurations including the following:

(a) the inverted F antenna that resonates in the two frequency bands of the first resonance wavelength 2*a* and the second resonance wavelength λβ, i.e., the first resonance frequency and the second resonance frequency;

(b) the loop antenna that resonates at the first resonance frequency, then the antenna apparatus can be configured which resonates at the first resonance frequency using the two antenna configuration of the inverted F antenna and the loop antenna, whose bandwidth of first resonance frequency is expanded, and which can be configured to be even more small-sized than the prior art.

First Modified Preferred Embodiment

Figure 5:
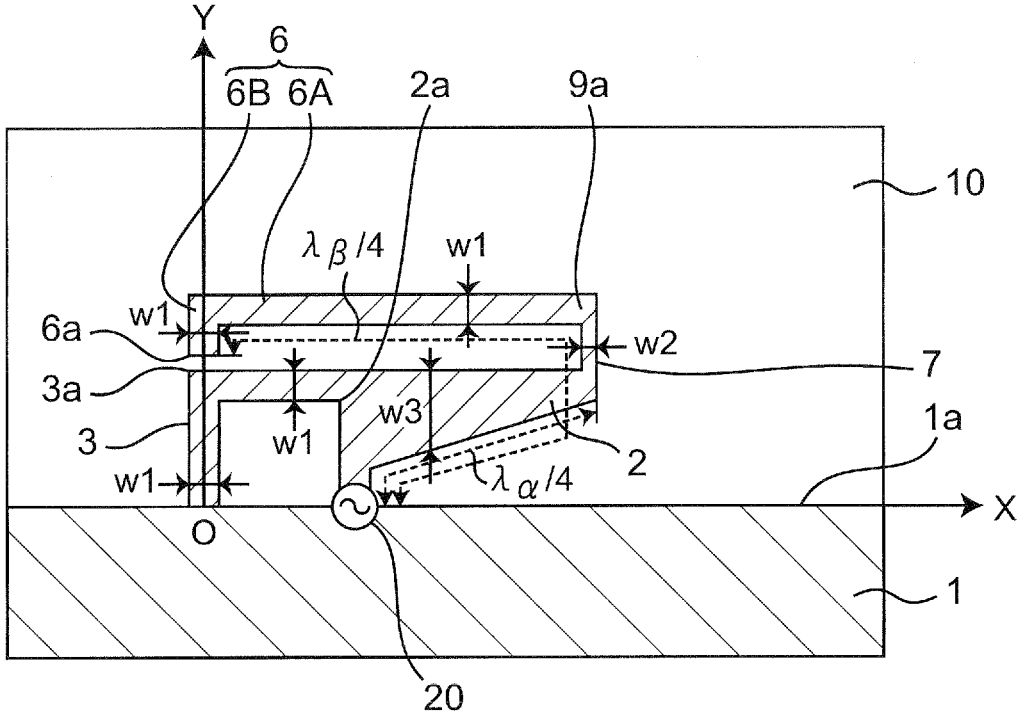
FIG. 5 is a plan view showing a configuration of an antenna apparatus according to a first modified preferred embodiment of the first preferred embodiment.

FIG. 5 is a plan view showing a configuration of an antenna apparatus according to the first modified preferred embodiment of the first preferred embodiment. The antenna apparatus of the first modified preferred embodiment is characterized in that the first antenna element 2 is formed to have a taper shape gradually increasing in width between another end thereof (right-hand end) toward its one end in the −X-axis direction to the connection point 2*a* by comparison to the first preferred embodiment. The other configuration is similar to that of the first preferred embodiment, and the characteristic configuration may be applied to the second preferred embodiment. In this case, the first resonance frequency fα is set to an electrical length from the feeding point 20 to a connection point with the third antenna element 7 along, for example, the edge of the first antenna element 2. The second resonance frequency fβ is set to an electrical length from the feeding point 20 to a connection point with the third antenna element 7 along, for example, the edge of the first antenna element 2 via the third antenna element 7 to the tip end of the second antenna element 6. It is noted that a connection point of the third antenna element 7 and the second antenna element 6 is assumed to be 9*a* in FIG. 5.

Figure 6A:
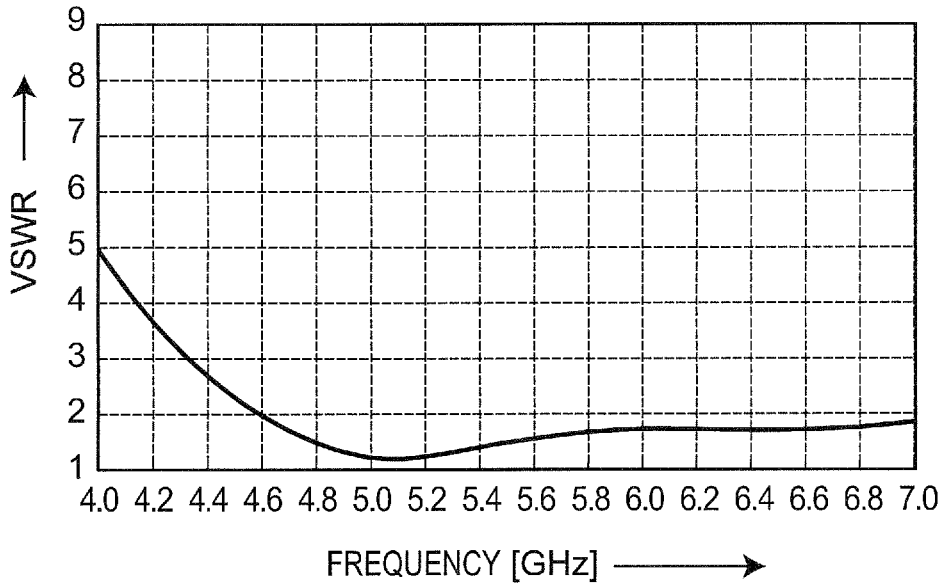
FIG. 6A is a graph showing a frequency characteristic of VSWR in the vicinity of the first resonance frequency fα in the antenna apparatus of FIG. 5.
Figure 6B:
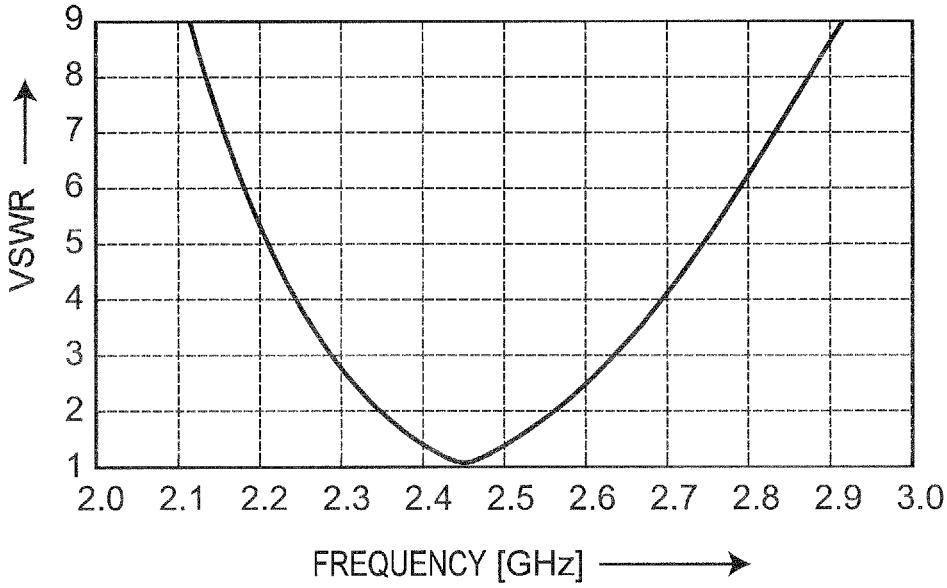
FIG. 6B is a graph showing a frequency characteristic of VSWR in the vicinity of the second resonance frequency fβ in the antenna apparatus of FIG. 5.

FIG. 6A is a graph showing a frequency characteristic of VSWR in the vicinity of the first resonance frequency fa in the antenna apparatus of FIG. 5, and FIG. 6B is a graph showing a frequency characteristic of VSWR in the vicinity of the second resonance frequency fβ in the antenna apparatus of FIG. 5. Impedance matching is obtained at 5 GHz including the resonance frequency fα as apparent from FIG. 6A, and impedance matching is obtained at 2.4 GHz including the resonance frequency fβ as apparent from FIG. 6B. As shown in FIG. 6A, a wide bandwidth of 4.8 to 7.0 GHz where VSWR is not greater than 2.0 is obtained, and VSWR has a low value.

As described above, according to the first modified preferred embodiment, the dual antenna apparatus can be configured, which resonates in two frequency bands of the first resonance wavelength λα and the second resonance wavelength λβ, i.e., the first resonance frequency and the second resonance frequency, by virtue of the taper shaped of the antenna element conductor extending from another end (right-hand end) of the first antenna element 2 to the lower end of the feeding antenna element 4, and in which the bandwidth of the first resonance frequency of the dual antenna apparatus is expanded.

Figure 7:
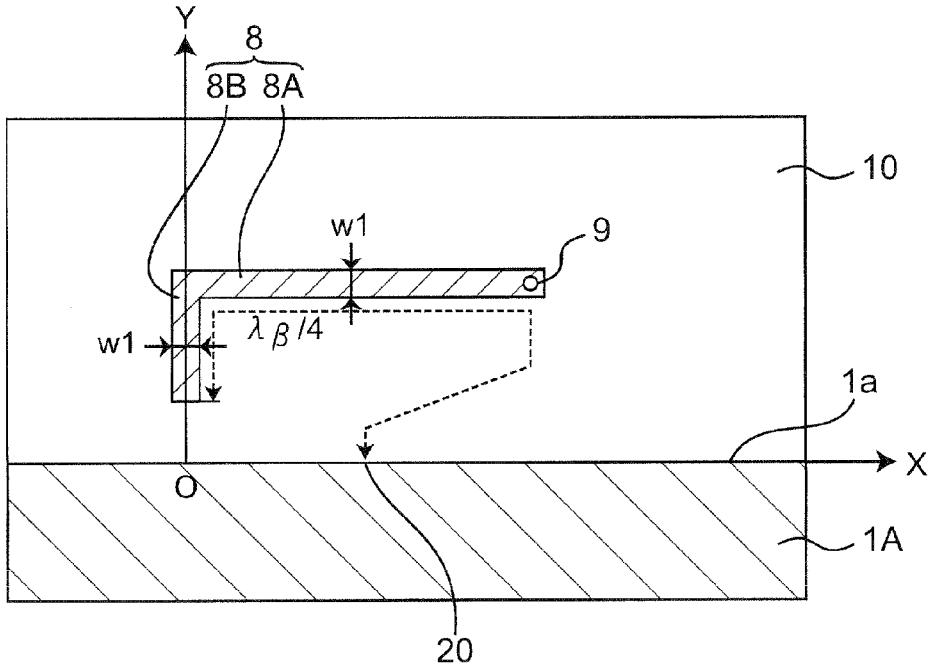
FIG. 7 is a plan view showing a configuration of the reverse surface of an antenna apparatus according to a modified preferred embodiment of the antenna apparatus of FIG. 5.

FIG. 7 is a plan view showing a configuration of the reverse surface of the antenna apparatus according to a modified preferred embodiment of the antenna apparatus of FIG. 5. FIG. 7 shows not any actual configuration but a perspective view seen from the obverse surface (indicated by solid lines for convenience in illustration although this should be normally indicated by dotted lines) for the sake of explanation of a relation to FIG. 1 and convenience in illustration, and the actual reverse surface is laterally reversed. In the present modified preferred embodiment, the antenna apparatus shown in FIG. 5 is formed on the obverse surface of the dielectric substrate 10, and the antenna apparatus of FIG. 7 is formed on the reverse surface of the dielectric substrate 10 as in the antenna apparatus of FIG. 3. In FIG. 7, the present modified preferred embodiment assumes a case where a length from the feeding point 20 via the first antenna element 2 to another end thereof and further via the third antenna element 7 to another end 6*a* of the second antenna element 6 is set shorter than a quarter wavelength of the second wavelength λβ, and no resonance occurs at the second resonance frequency fβ.

According to the present modified preferred embodiment, the antenna apparatus can be configured having a configuration of a combination of the antenna apparatus of FIG. 5 and the antenna apparatus of FIG. 7 and having action and advantageous effects of both of them. That is, a length, from the feeding point 20 by way of the first antenna element 2 and the third antenna element 7 via the one end (right-hand end) of the second antenna element 6 through the through-hole conductor 9, to the open end of the fourth antenna element 8, is set to λβ/4 that is a quarter wavelength of the second wavelength λβ, so that an inverted F antenna resonating at the second resonance frequency fβ is established. Therefore, even in a case where the second antenna element 6 cannot secure an electrical length for achieving resonance at the second resonance frequency fβ (when the length (electrical length) of the second radiating element is smaller than λβ/4) due to restrictions in size reduction in the Y-axis direction, the present modified preferred embodiment allows the resonance at the second resonance frequency fβ to be achieved by virtue of the provision of the fourth antenna element 8 on the reverse surface of the dielectric substrate 10.

Second Modified Preferred Embodiment

Figure 8:
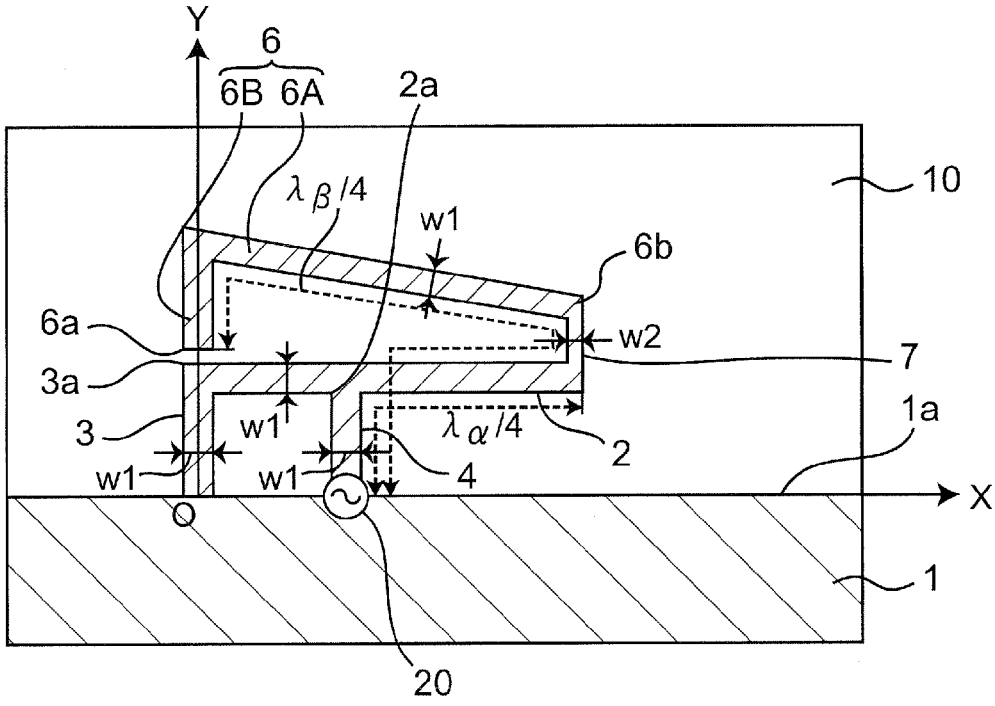
FIG. 8 is a plan view showing a configuration of an antenna apparatus according to a second modified preferred embodiment of the first preferred embodiment.

FIG. 8 is a plan view showing a configuration of an antenna apparatus according to the second modified preferred embodiment of the first preferred embodiment. Referring to FIG. 8, the antenna apparatus of the second modified preferred embodiment is characterized in that the second antenna element 6 is formed to be inclined by, for example, about 20 degrees from the X-axis direction by comparison to the antenna apparatus of the first preferred embodiment. The features of the antenna apparatus of the second modified preferred embodiment is that the second antenna element 6 is not required to be formed substantially parallel to the X-axis direction. The configuration of the second modified preferred embodiment may be applied to each of the aforementioned preferred embodiments or the first modified preferred embodiment.

Figure 9:
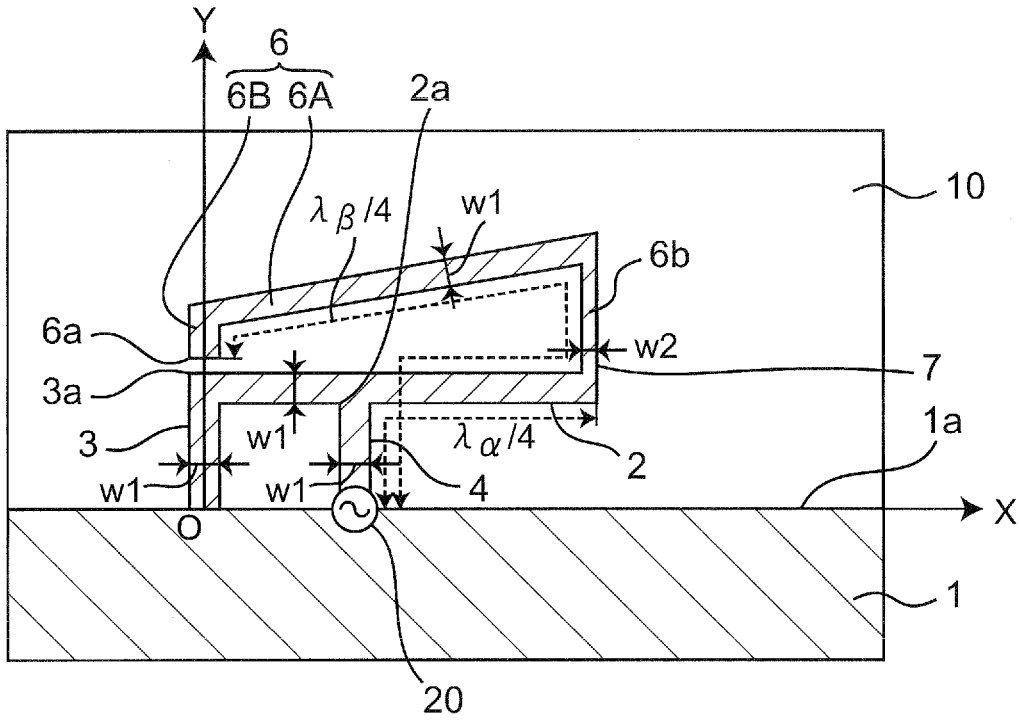
FIG. 9 is a plan view showing a configuration of an antenna apparatus according to a modified preferred embodiment of the antenna apparatus of FIG. 8.

FIG. 9 is a plan view showing a configuration of an antenna apparatus according to a modified preferred embodiment of the antenna apparatus of FIG. 8. The antenna apparatus of FIG. 9 is characterized in that the length of the third antenna element 7 is set to be longer than the length of the element portion 6B of the second antenna element 6. With this arrangement, the electrical length of the second resonance frequency can be substantially lengthened by operating the third antenna element 7 as an extension coil.

Other Modified Preferred Embodiments

Figure 10:
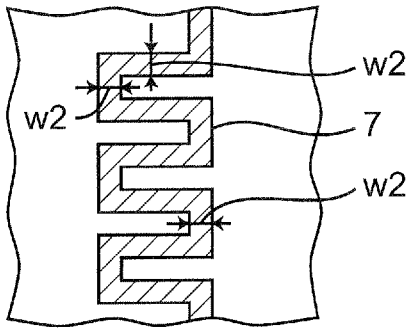
FIG. 10 is a plan view showing a third antenna element 7 of a meander shape according to modified preferred embodiments of each preferred embodiment and its modified preferred embodiment.
Figure 11:
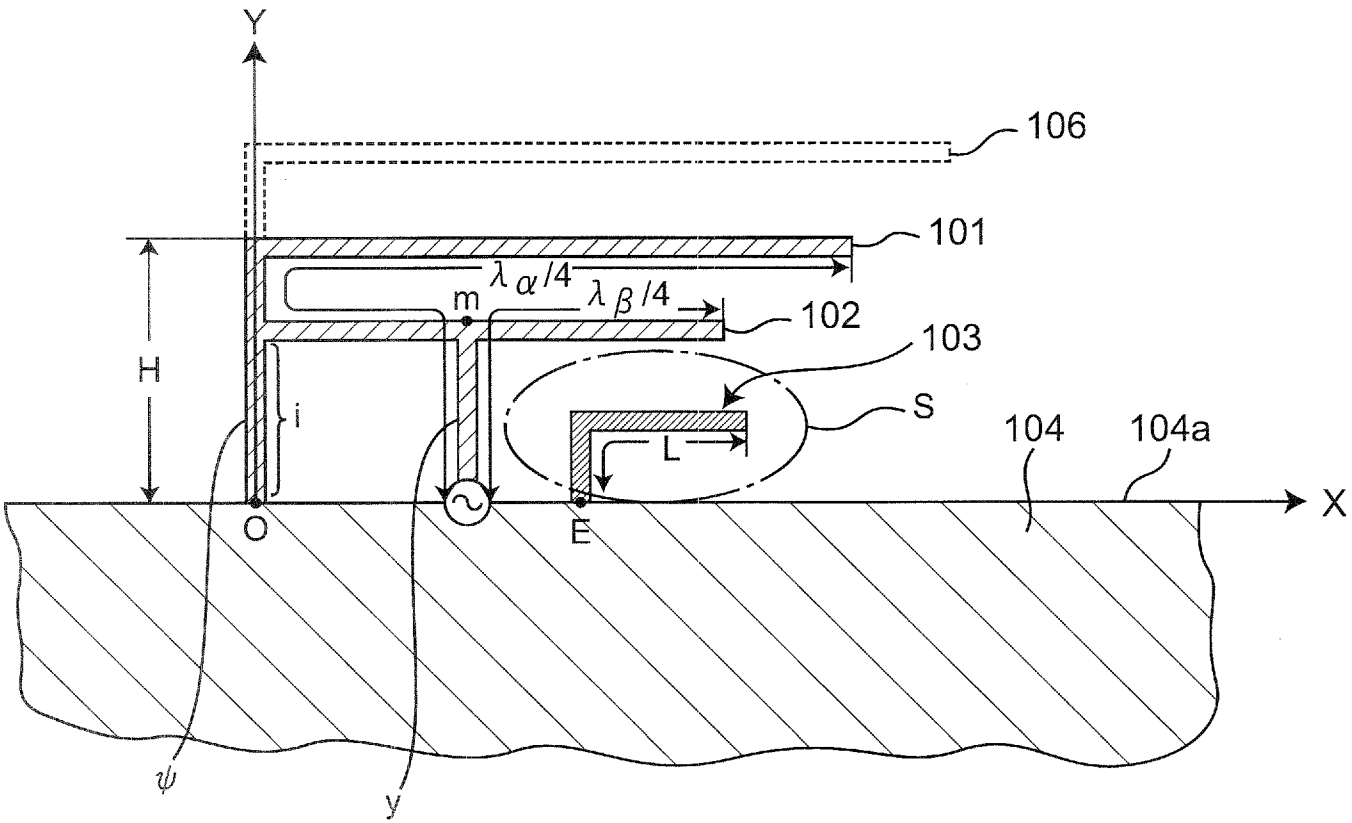
FIG. 11 is a longitudinal sectional view showing a configuration of the prior art dual-frequency resonant antenna apparatus.
Figure 12:
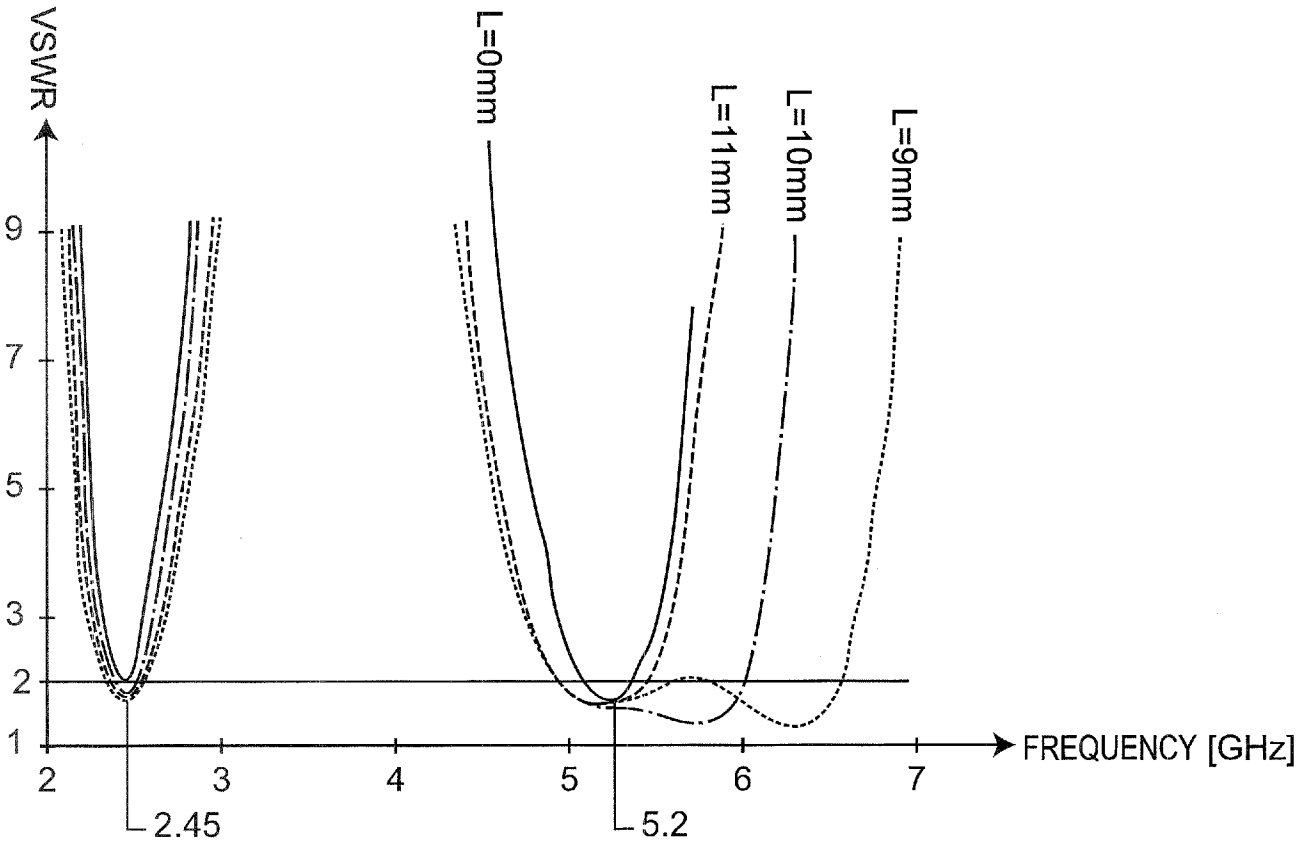
FIG. 12 is a graph showing a frequency characteristic of VSWR of the dual-frequency resonant antenna apparatus of FIG. 11.

FIG. 10 is a plan view showing a third antenna element 7 of a meander shape according to a modified preferred embodiment of each of the aforementioned preferred embodiments and their modified preferred embodiments. Although the third antenna element 7 is formed of the strip conductor of a linear shape in the aforementioned preferred embodiments and the like, the present invention is not limited to this, and the antenna element may be formed in a meander shape having a width w2 as shown in FIG. 10. With this arrangement, the electrical length of the third antenna element 7 can be lengthened further than in the aforementioned preferred embodiments and the like, and the electrical length of the second resonance frequency can be lengthened.

Moreover, the fourth antenna element 8 on the reverse surface shown in FIGS. 3 and 7 may be applied to the preferred embodiments and the like other than the antenna apparatuses of FIGS. 1 and 5.

As described in detail above, according to the present invention, the antenna width can be shortened by bending the end portion of the second antenna element toward the direction of the grounding conductor. Since resonance occurs in both the inverted F antenna that resonates at the first antenna element and the loop antenna, the first resonance frequency band (5-GHz band) is expanded. Moreover, since the end portion of the second antenna element is bent, the width of the antenna apparatus can be reduced for size reduction. The antenna apparatus of the present invention is useful as a bandwidth expanding technique of the antenna that resonates in two frequency bands.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An antenna apparatus, comprising:

a grounding antenna element having one end connected to a grounding conductor;

a first antenna element formed to be substantially parallel to a peripheral edge portion of the grounding conductor, the first antenna element having one end connected to another end of the grounding antenna element;

a feeding antenna element configured to connect a feeding point with a predetermined connection point on the first antenna element;

a third antenna element having one end connected to another end of the first antenna element; and a second antenna element having one end connected to another end of the third antenna element, wherein a first coupling capacitance is formed between the second antenna element and the grounding antenna element by bending another end of the second antenna element to be adjacent to the grounding antenna element so that another end of the second antenna element is electromagnetically coupled to another end of the grounding antenna element, wherein a first length, from the feeding point via the feeding antenna element, a connection point on the first antenna element and the first antenna element, to another end of the first antenna element, is set to a length of a quarter wavelength of a first resonance frequency, so that a first radiating element having the first length resonates at the first resonance frequency, wherein a second length, from the feeding point via the feeding antenna element, a connection point on the first antenna element, the first antenna element, the third antenna element and the second antenna element, to another end of the second antenna element, is set to a length of a quarter wavelength of the second resonance frequency, so that a second radiating element having the second length resonates at the second resonance frequency, wherein a third length, from the feeding point via the feeding antenna element, a connection point on the first antenna element, the first antenna element, the third antenna element, the second antenna element and the first coupling capacitance, to the grounding antenna element, is set to a length which is one of a half wavelength and three-quarter wavelength of the first resonance frequency, so that a third radiating element having the third length and constituting a loop antenna resonates at the first resonance frequency, and wherein the first antenna element is formed so that a width from another end of the first antenna element to a connection point between the first antenna element and the feeding antenna element is gradually expanded in a shape of taper shape toward the connection point.

2. The antenna apparatus as claimed in claim 1, wherein the grounding antenna element is formed to be substantially perpendicular to the peripheral edge portion of the grounding conductor, wherein the third antenna element is formed to be substantially perpendicular to the peripheral edge portion of the grounding conductor, and wherein the second antenna element is formed to be substantially parallel to the peripheral edge portion of the grounding conductor.

3. The antenna apparatus as claimed in claim 1, wherein the first antenna element, the second antenna element, the third antenna element, the feeding antenna element, and the grounding antenna element are formed on a substrate.

4. An antenna apparatus comprising:

a grounding antenna element having one end connected to a grounding conductor;

a first antenna element formed to be substantially parallel to a peripheral edge portion of the grounding conductor, the first antenna element having one end connected to another end of the grounding antenna element;

a feeding antenna element configured to connect a feeding point with a predetermined connection point on the first antenna element;

a third antenna element having one end connected to another end of the first antenna element;

a second antenna element having one end connected to another end of the third antenna element; and a fourth antenna element formed on a surface opposite to the surface of the substrate on which the second antenna element is formed, the fourth antenna element having one end connected to one end of the second antenna element via a through-hole conductor formed in a thickness direction of the substrate, wherein a first coupling capacitance is formed between the second antenna element and the grounding antenna element by bending another end of the second antenna element to be adjacent to the grounding antenna element so that another end of the second antenna element is electromagnetically coupled to another end of the grounding antenna element, wherein a second coupling capacitance is formed between the fourth antenna element and the grounding antenna element by bending another end of the fourth antenna element to be adjacent to the grounding antenna element so that another end of the fourth antenna element is electromagnetically coupled to another end of the grounding antenna element, wherein a first length, from the feeding point via the feeding antenna element, a connection point on the first antenna element and the first antenna element, to another end of the first antenna element, is set to a length of a quarter wavelength of a first resonance frequency, so that a first radiating element having the first length resonates at the first resonance frequency, wherein a third length, from the feeding point via the feeding antenna element, a connection point on the first antenna element, the first antenna element, the third antenna element, the second antenna element and the first coupling capacitance, to the grounding antenna element, is set to a length which is one of a half wavelength and three-quarter wavelength of the first resonance frequency, so that the third radiating element having the third length and constituting a loop antenna resonates at the first resonance frequency, wherein a fourth length, from the feeding point via the feeding antenna element, a connection point on the first antenna element, the first antenna element, the third antenna element, the through-hole conductor, the fourth antenna element and the second coupling capacitance, to the grounding antenna element, is set to a length which is one of a half wavelength and three-quarter wavelength of the first resonance frequency, so that a fourth radiating element having the fourth length and constituting a loop antenna resonate at the first resonance frequency, and wherein a fifth length, from the feeding point via the feeding antenna element, a connection point on the first antenna element, the first antenna element, the third antenna element and the through-hole conductor, to another end of the fourth antenna element, is set to a length of a quarter wavelength of a second resonance frequency, so that a fifth radiating element having the fifth length and constituting an inverted F antenna resonates at the second resonance frequency.

5. The antenna apparatus as claimed in claim 4, wherein the first antenna element is formed so that a width from another end of the first antenna element to a connection point between the first antenna element and the feeding antenna element is gradually expanded in a form of taper toward the connection point.

* * * * *